US006651643B2

(12) United States Patent
Simonds

(10) Patent No.: US 6,651,643 B2
(45) Date of Patent: Nov. 25, 2003

(54) BLENDED FIBER BOW STRING CONSTRUCTION

(75) Inventor: Gary L. Simonds, West Salem, WI (US)

(73) Assignee: Mathew McPherson, Norwalk, WI (US)

( * ) Notice: Subject to any disclaimer, the term of this patent is extended or adjusted under 35 U.S.C. 154(b) by 70 days.

(21) Appl. No.: 10/001,135

(22) Filed: Nov. 1, 2001

(65) Prior Publication Data

US 2003/0079732 A1 May 1, 2003

(51) Int. Cl.[7] ..... F41B 5/14
(52) U.S. Cl. ..... 124/90
(58) Field of Search ..... 57/243, 244; 124/90

(56) References Cited

U.S. PATENT DOCUMENTS 4,702,067 A * 10/1987 Izuta
4,957,094 A 9/1990 Pickering et al. ..... 124/24.1
5,598,831 A * 2/1997 Izuta ..... 124/90
5,688,594 A * 11/1997 Lichscheidt et al.
5,715,804 A * 2/1998 Izuta ..... 124/90
5,752,496 A 5/1998 McPherson ..... 124/90
5,852,926 A 12/1998 Breedlove ..... 57/210
5,884,617 A 3/1999 Nelson ..... 124/90
6,045,906 A * 4/2000 McMahon et al.
6,237,582 B1 5/2001 McPherson ..... 124/25.6
6,381,940 B1 * 5/2002 Kolmes et al.

* cited by examiner

*Primary Examiner*—John A. Ricci
(74) *Attorney, Agent, or Firm*—Vidas, Arrett & Steinkraus

(57) ABSTRACT

A bowstring including a plurality of strands, each strand including at least one first fiber and at least one second fiber, at least one of the first fiber or the second fiber being liquid crystal polymer and at least one of the first fiber or the second fiber being ultra high molecular weight polyolefin.

29 Claims, 5 Drawing Sheets

BLENDED FIBER BOW STRING CONSTRUCTION

FIELD OF THE INVENTION

The present invention relates to bowstrings for archery bows which are made from a plurality of high strength strands which are a blend of at least two fibers, some of the fibers being made of a first material and some of the fibers being made of a second material. The blend of fibers results in a bowstring having high tensile strength and good creep resistance.

BACKGROUND OF THE INVENTION

The bow and arrow is one of the earliest weapons conceived by man and have been in use for tens of thousands of years. In its simplest form the bow was a bent stick that was held in the bent condition by having a string of somewhat shorter length attached to either end. By holding this braced stick in one hand, one could place one end of a second straight stick against the string and by pulling both the stick and string away from the bow hand and releasing, could launch the second stick. Over the years there have been great advances in the development of the bow, composite bows, composite recurve bows, and state of the art compound bows that represent different stages of bow sophistication.

Similarly, there have been advances in the materials used for making bowstrings. Some of the earliest bowstrings were manufactured from animal fibers such as sinew. Later, bowstrings were manufactured from other fibers such as flax or linen.

In the last century, bowstrings have been most commonly manufactured from manmade fibers with DACRON® polyester available from DuPont being the most popularly used material through the later 1980's. DACRON® B-50 was the most commonly used of the DACRON® fiber materials with the "50" being used to refer to a single strand breaking strength (tensile strength) of about 50 pounds. This material exhibited very consistent mechanical properties and performance, had good abrasion resistance, and exhibited durability when used in bowstrings.

The popularity of DACRON® bowstrings decreased, however, with the appearance of KEVLAR® polyparaphenylene terephthalamide (aramid fiber), another popular synthetic material used in the 80's and also available from DuPont. KEVLAR® exhibited a higher tensile strength at break and thus higher breaking strength per strand, and also had a much higher modulus of elasticity as compared to DACRON® which resulted in improved performance characteristics, and the higher tensile strength allowed a reduced number of strands which more than compensated for its higher density. Lighter mass weight technically results in a higher arrow launch velocity. However, KEVLAR® exhibited a limited life expectancy, sometimes producing only 1000 to 1500 shots per string, the use of KEVLAR® was predominantly limited to traditional bows specifically designed for use with KEVLAR® bowstrings, and its use was limited to a relatively small number of top level tournament archers due to its low resistance to cyclic bending.

In the later 1980's a new synthetic string material came on the scene, this material was made from SPECTRA® 1000 ultra high molecular weight polyethylene fiber available from the High Performance Fibers Group of AlliedSignal, Inc. Bowstrings material manufactured of SPECTRA® polyethylene is available from Brownell under the tradename of FAST FLIGHT®.

U.S. Pat. No. 4,957,094 entitled COMPOUND ARCHERY BOW WITH NON-STRETCH BOWSTRING AND ECCENTRICS FOR SECURING THE SAME describes bowstrings and cable harnesses manufactured from SPECTRA®.

The SPECTRA® fiber was also a very high strength fiber with a very high modulus of elasticity and a density less than the fiber used in DACRON® B-50. This material, in addition to being lightweight, and having high strength and high modulus, also exhibits excellent durability and excellent abrasion resistance. Significantly improved performance was exhibited by bows using SPECTRA® 1000 (FAST FLIGHT® bowstrings) as compared to DACRON® B-50 bowstrings with one particular improvement being higher arrow launch velocity exhibited with the SPECTRA® made bowstrings.

However, SPECTRA® material is subject to creep. Creep or stretch of the bowstring is a typical problem encountered by archers using the SPECTRA® made bowstrings. When the bow is subject to a load, both when holding the bow in the brace condition and when the bowstring is drawn and released for arrow propulsion, the string elongates in proportion to the load applied. For many materials, the string returns to its original length once the load is removed. If a material exhibits creep, however, the string does not fully return to its original length, and the string will elongate or stretch permanently over a given period of time. Time, temperature, and the applied load can influence the rate and severity of the stretching due to creep. This obviously affects the performance of the bow.

Another ultra high molecular weight polyethylene is sold under the tradename of DYNEEMA® available from DSM-Toyobo, which is made by a different process than SPECTRA®. This polymer, however, also exhibits lower resistance to creep.

Since the appearance of SPECTRA® there have been several other new synthetic fibers introduced which have been utilized in the manufacture of bowstrings. Examples of these materials include VECTRAN® liquid crystal polymer (LCP) available from Hoechst Celanese Corp. and ZYLON® poly(p-phenylene-2-6-benzobisoxazole) available from Toyobo Co.

VECTRAN® does not exhibit poor creep characteristics as compared to SPECTRA® and provides high tensile strength and modulus. However, VECTRAN®, like KEVLAR®, also suffers from lower abrasion resistance and a short life expectancy, but to a lesser degree than the latter. Another disadvantage of VECTRAN® is that it has a lower modulus of elasticity than SPECTRA® which ultimately results in lower arrow velocities than can be achieved with SPECTRA®.

ZYLON® is made up of rigid rod chain molecules of poly (p-phenylene-2,6-benzobisoxazole) (PBO). ZYLON® fibers exhibit some of the he best mechanical properties available and have high strength, high modulus, and no negative creep characteristics. However, to date, there is little experience with the material for use in bowstrings. One disadvantage that has been observed with the ZYLON® material itself is that its strength is severely affected by sunlight. This may restrict its use in bowstrings. To date, there has been no single material that achieves the desired level of performance when used in a bowstring. Each material exhibits a particular weakness or weaknesses.

Attempts have therefore been made to combine materials in order to achieve the desired characteristics. One attempt resulted in bowstrings referred to as "KEVDAC" which referred to the fact that they were made up of individual strands of KEVLAR® and DACRON®, each string being composed of an equal number of strands of each material. This resulted in a string wherein the worst properties of both materials were exhibited. Strings made of KEVDAC® did not significantly improve arrow launch velocity and exhibited the short life expectancy of KEVLAR®.

Another attempt used a blended material, "S4", wherein SPECTRA® polyethylene and VECTRAN® LCP were actually blended at a 50/50 ratio at the fiber level rather than at the strand level. These strings did not exhibit any negative creep characteristics but their life expectancy was still relatively short and somewhat unpredictable.

These materials have also been blended at a ratio of 68% SPECTRA® polyethylene to 32% VECTRAN® LCP and marketed under the tradename of "450 Plus". However, this blend still did not achieve the level of dynamic performance exhibited by a bowstring manufactured only of SPECTRA®, although it had a reasonable life expectancy and no negative creep characteristics.

U.S. Pat. No. 5,884,617 describes bowstrings constructed of braided strands, preferably comprising flat braids, from a high strength mixture of yams comprising abrasion-resistant fibers and yams comprising high strength, creep resistant fibers.

SUMMARY OF THE INVENTION

The present invention relates to a bowstring for an archery bow that exhibits improved properties such as good life expectancy, negligible creep, and enhances bow performance.

In the broadest sense, the present invention relates to a bowstring made up of a plurality of strands each strand made of at least two different fibers, each fiber having a minimum modulus of elasticity of about 8,000,000 psi and a minimum ultimate tensile of about 350,000 psi.

More particularly, the present invention relates to a bowstring which is about 10 wt-% to 30 wt-% liquid crystal polymer and 70 wt-% to about 90 wt-% ultra high molecular weight polyolefin.

More particularly, the present invention relates to a bowstring made of a plurality of strands each strand being made of a blend of at least two different fibers. The bowstring is of a composition such that about 10 wt-% to 30 wt-% of the bowstring is liquid crystal polymer and 70 wt-% to about 90 wt-% of the bowstring is ultra high molecular weight polyolefin.

The present invention further relates to an archery bow having a bowstring of the present invention, and more particularly, the present invention relates to an archery bow having a handle portion, upper and lower limbs having outside ends, the limbs attached to the handle portion and extending outwardly therefrom with the outside ends, and a bowstring attached to the outside ends made of a plurality of strands each strand made of a blend of at least two fibers. The resultant bowstring is about 10 wt-% to 30 wt-% liquid crystal polymer and 70 wt-% to about 90 wt-% ultra high molecular weight polyolefin.

The bowstring may be attached to the outside ends using any means known to those of skill in the art.

The archery bow may be a compound bow, and may further include a pair of rotation members rotatably mounted on the outer ends of each limb, the bowstring extending between the rotation members.

DETAILED DESCRIPTIONS OF THE PREFERRED EMBODIMENTS

The present invention is directed to making bowstrings of a plurality of strands which in turn are made of at least two fibers, one fiber of which is made of a first material, and one fiber of which is made of a second material. The first and second materials are selected so as to have high moduli of elasticity that are substantially similar, and at least one of the materials has a high ultimate strength as determined by measuring tensile at break. Suitably, the modulus of elasticity of each of the materials is greater than about 8,000,000 psi. The ultimate tensile of at least one of the materials is greater than about 350,000 psi.

As used herein, the term "ultra high molecular weight" (UHMW) shall be used to refer to those polyolefin (PO) polymers having a molecular weight of greater than about one million, and more suitable from about 3–6 million and a density of greater than about 9 grams per cubic centimeter or 0.0325 pounds per cubic inch.

As used herein the term "string" shall be used to describe a bundle or plurality of strands, each strand being comprised of at least two different fibers or monofilaments. Typically, a yarn titer is made up of a plurality of fibers and in turn one or more yarn titers are twisted together to form a strand of bowstring material. The bundle or plurality of strands thus makes up the bowstring.

Suitable materials for use in making the strands of the present invention include liquid crystal polymers (LCP) and ultra high molecular weight polyolefins (UHMW-PO). An example of a useful LCP fiber is VECTRAN® HS or M available from Celanese, which is based on VECTRA® A950 polymer resin available from Hoechst Celanese Corp. Examples of useful UHMW-PO fibers include SPECTRA® 1000 ultra high molecular weight polyethylene (UHMW-PE) available from the High Performance Fibers Group of AlliedSignal and DYNEEMA® UHMW-PE available from DMS-Toyobo.

The above referenced fibers, UHMW-PE and LCP, exhibit modulus of elasticity which are relatively close in value and ultimate strength which are relatively close in value. The UHMW-PE fibers typically have a modulus of elasticity of about $1.25\times10^6$ to $1.5\times10^6$ psi and an ultimate tensile strength of about $3.5\times10^5$ to about $5\times10^5$ psi and the LCP fibers typically have a modulus of elasticity of about $9.5\times10^5$ psi and an ultimate tensile strength of about $4.2\times10^5$ psi.

Figure 1:
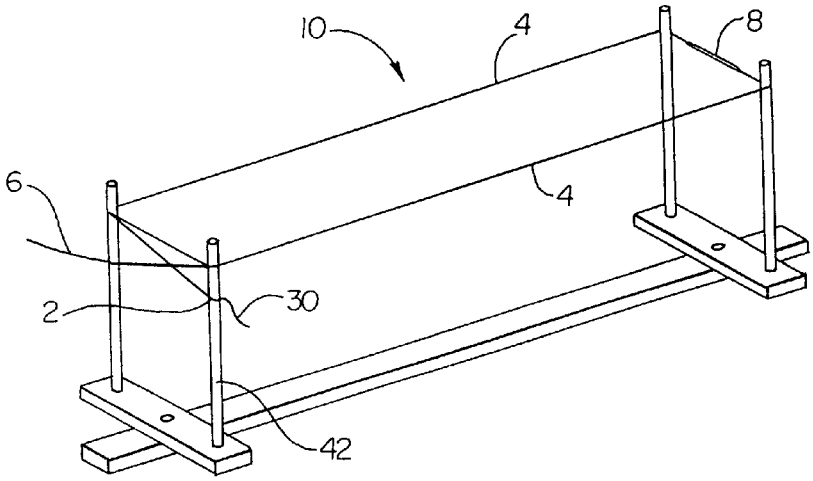
FIG. 1 illustrates a four post bowstring lay-up fixture.
Figure 2:
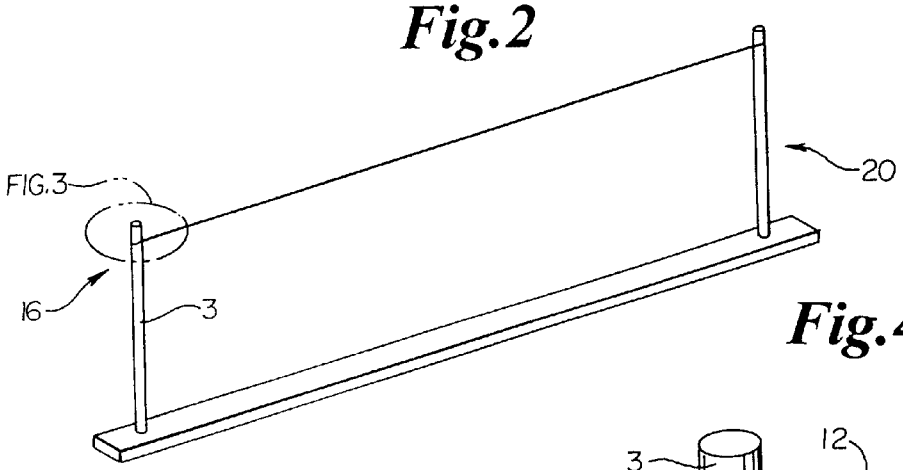
FIG. 2 illustrates a two-post bowstring lay-up fixture.

FIG. 1 illustrates generally at 10, a typical four-post manual fixture for laying up a bowstring. Starting end 2 of a single strand 30 is tied off at post 42. Strand 30 is typically supplied in a spool form. Single strand 30 is then wrapped around each post 42 of fixture 10 about 3–12 times resulting in a bowstring 15 with about 6–24 strands ending at finishing end 6 of single strand 30. The bundle of 3–12 stands, half the number of strands of the finished bowstring, is represented at 4. The bundle of 6–24 strands, now a bowstring, is represented at 15. Starting end 2 and finishing end 6 may then be tied together and wrapped in the area of the tie to assure that the bundle of strands 4 is securely held together. Alternatively, FIG. 2, illustrates generally at 20 a simple two-post lay-up structure for finishing the end loops on the bowstring 15. It is important to note, however, that most commercially manufactured bowstrings are made on semi-automated equipment using a procedure similar to those described above.

Figure 4:
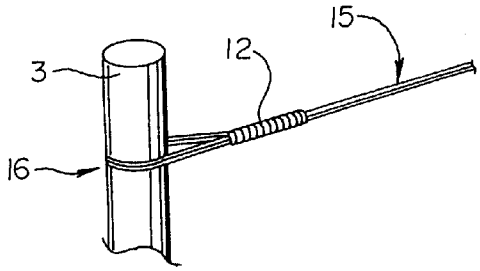
FIG. 4 shows an enlarged image of string halves which are brought together and served.
Figure 3:
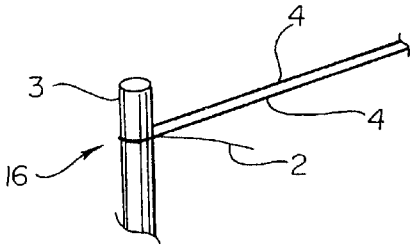
FIG. 3 shows an enlarged image of the same two-post bowstring lay-up fixture as that shown in FIG. 2.
Figure 5:
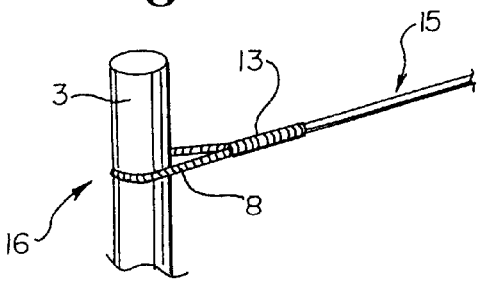
FIG. 5 illustrates an alternative method of finishing a string loop.

FIGS. 3, 4 and 5 illustrate enlarged views of circled area 16 in FIG. 2. As an be seen from FIG. 3, approximately half of the total strands of the final bowstring 4, re located on either side of post 3.

To finish the lay up of the bowstring 15, the starting 2 or finishing 6 end an be used to bind both sides of the strands 4 together to make the final bowstring 15 with a series of knots or with separate serving 12 as shown in FIG. 4. An alternative end loop arrangement is shown in FIG. 5 wherein the previously served portion 8 of the string 15 is looped around a single post 3 and two halves 4, each having half the number of strands of finished string 15, i.e. each having 3–12 strands, are served together at 13 to form the bowstring 15.

Figure 6:
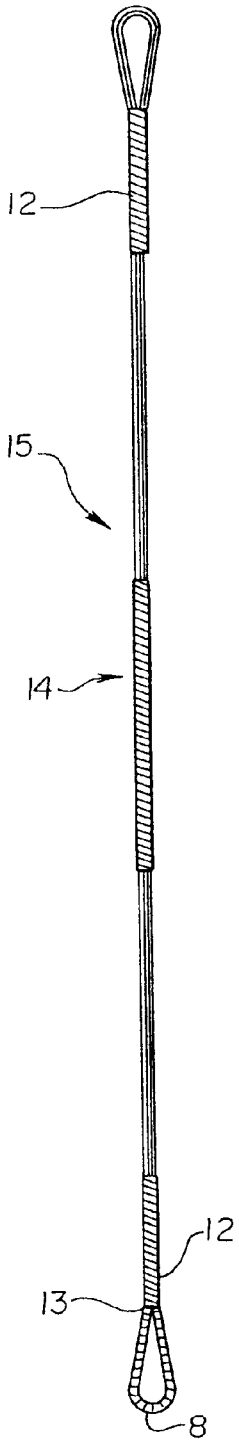
FIG. 6 shows two alternative bowstring lay-ups having different twist and loop treatments.
Figure 6A:
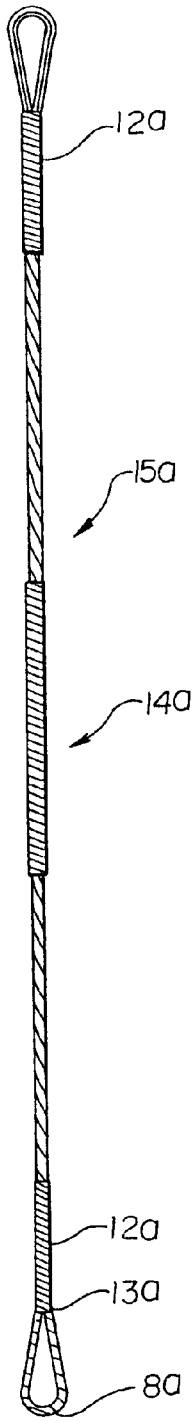
Figure 7:
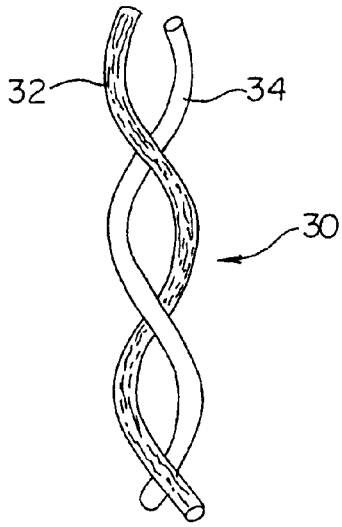
FIG. 7 illustrates a basic single bowstring strand composition.
Figure 8:
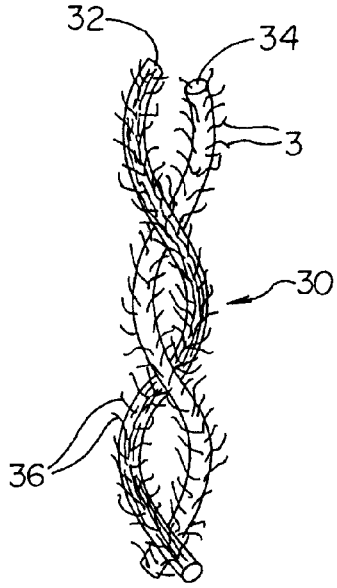
FIG. 8 illustrates a single bowstring strand composed of two commingled yarn titers.

FIGS. 6 and 6*a* illustrate generally at 15 and 15*a*, two different embodiments of a finished bowstring. Each string is made up of a plurality of strands 30. In each embodiment, each strand 30 is formed by twisting one or more yarn titers 34 of UHMW-PE with one or more yarn titers 32 of LCP, as shown in FIGS. 7 and 8, either twisted clockwise or counterclockwise a predetermined number of times per unit length. The individual strands 30 thus formed are then laid up on a fixture 10 or 20 as shown in FIGS. 1 and 2 and the free ends 2, 6 tied off and bound, i.e. served, to create the bowstring 15, 15*a*. If the free ends 2, 6 occur at the same end of the string lay-up, they are often tied or bound together. If, on the other hand, the free ends 2, 6 occur at opposite ends of the lay-up, then each may be tied off and/or bound as described previously. The individual strands 30, may be served together at the end loops 8, at the ends 12, and intermediately 14, using any conventional means known in the art.

Typically, between 6 and 24 strands, and more typically between 8 and 22 individual strands may make up the bowstring, but this number may be more or less depending on the size, i.e. the diameter, of each strand and the draw weight of the bow on which the bowstring is employed. The finished bowstring should be of a certain diameter, particularly at the center serving 14 where the arrow is nocked in order to meet the requirements set by the Archery Manufacturers Organization Standards for proper arrow nock fit. The bowstrings should also be within certain diameter tolerances at the served or bound ends 12 to provide an optimum fit with the cam grooves in which they may be fitted.

Optionally, the individual yarn titers 32, 34 as shown in FIG. 8, may be combined using air for commingling of the fibers 36, 38 of the yarn titers 32, 34 as they are being twisted into a single strand 30 of bowstring material.

In one embodiment, as described in U.S. Pat. No. 5,752,496 incorporated by reference herein in its entirety, a bowstring may be formed of a number of strands that have been twisted in the clockwise direction, and a number of strands that have been twisted in the counterclockwise direction, the number of each of which may be approximately equal. The number in either direction may vary slightly, however, and a given number of strands twisted in a given direction may be increased to offset the likelihood that the bowstring itself may be twisted during the process of making and mounting it on the bow as illustrated by FIGS. 6*a* and 11.

Figure 9:
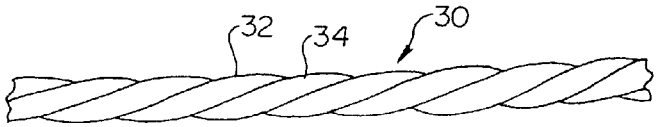
FIG. 9 shows an alternative view of a single strand composed of two different yarn titers.

FIG. 7 illustrates generally at 30, one way of making a strand. Strand 30 is made of at least two yarn titers 32, 34. In one embodiment, one yarn titer is liquid crystal polymer (LCP) and one yarn titer is ultra high molecular weight polyolefin (UHMW-PO) such as polyethylene (UHMW-PE). More typically, 32 may be a plurality of yarn titers and 34 may be a plurality of yarn titers which are then twisted together to make a strand. The yarn titers are twisted individually and about one another in a clockwise direction to form an individual strand. Alternatively, the yarn titers may be twisted together in the opposing direction. FIG. 9 illustrates the same strand 30 after twisting yarn titers 32, 34 about one another.

Figure 10:
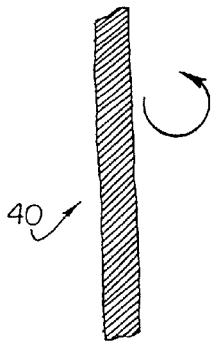
FIG. 10 illustrates a single bowstring strand which has been combined using a clockwise twist.
Figure 11:
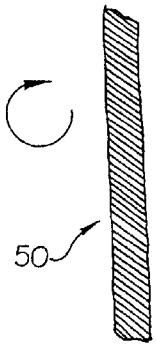
FIG. 11 illustrates a single bowstring strand that has been combined using a counter clockwise twist.

FIGS. 10 and 11 illustrate generally at 40, 50 alternative twist patterns used in making individual strands. In FIGS. 10 and 11, the strands are again made of at least two yarn titers, one of which may be LCP and one of which may be UHMW-PO. More typically, there may be a plurality of each type of yarn titer used in making the strand. The bowstring would then be made of a plurality of strands. FIG. 10 shows a strand designated generally at 40 twisted in a counterclockwise direction for a predetermined number of twists per unit length. FIG. 11 shows a strand designated generally at 50 twisted in a clockwise direction for a predetermined number of twists per unit length. The number of twists in a strand may be typically about 2–5 twists per inch. The strands as shown, may then be bundled to make a bowstring. As noted above, about 6–24, and more typically about 8–22 strands may make up a bowstring but this may be more or less depending on the size of each strand, i.e. the diameter.

Figure 12:
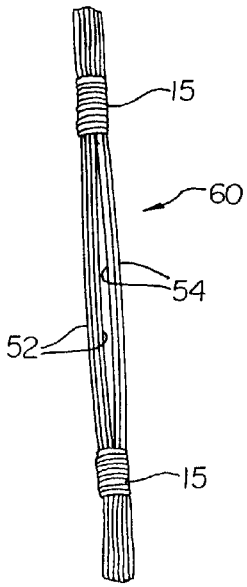
FIG. 12 illustrates a bowstring composed of two separate bundles of clockwise and counterclockwise strands.
Figure 13:
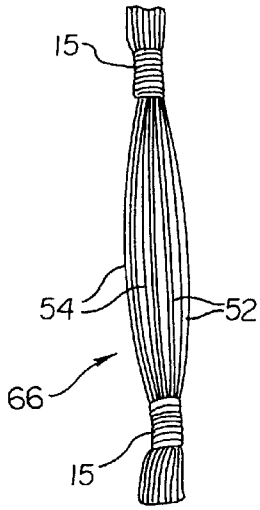
FIG. 13 illustrates a bowstring composed of clockwise and counter clockwise strands which are intermingled.

FIGS. 12 and 13 illustrate generally at 60, 66 two different methods of grouping the individual strands into a bowstring.

While these are exemplary as to how the strands might be grouped together, they are not intended as exclusive of the ways in which this could be done, nor are they intended to limit the scope of the invention as such. In FIG. 12, the clockwise twisted strands 54 and the counterclockwise twisted strands 52 are grouped separately first to form one grouping of clockwise twisted strands 54 and a separate grouping of counterclockwise twisted strands 52. These two groupings are then bound together in parallel fashion without intermixing. In both groups, there are a substantially equal number of strands 52 and strands 54. In FIG. 13 the clockwise twisted strands 54 and counterclockwise twisted strands 52 are intermixed and substantially equally dispersed throughout the bowstrings 66 in a random fashion.

Strands and bowstrings as described herein may be made according to the method as described in U.S. Pat. No. 5,752,496 incorporated by reference, above, in its entirety. However, while this method is intended as an illustration of how a strand and bowstring may be made, one of skill in the art would understand that a strand may be made in different ways without departing from the scope of the present invention. As noted above, the bowstrings are made up of a plurality or bundle of strands. The strands are made of at least two different yarn titers, the two different yarn titers being made of a first material and a second material different from the first material. Preferably, the bowstrings made according to the invention will be in a non-braided configuration.

An example of a bowstring made according to the present invention is one in which the strands are made of a blend of yarn titers some of which are ultra high molecular weight polyethylene (UHNW-PE) such as SPECTRA® or DYNEEMA®, and some of which are liquid crystal polymer (LCP) such as VECTRAN®.

Using a blend such as this, the performance and durability of the SPECTRA® or DYNEEMA® UHMW-PE's are maintained and the addition of VECTRAN® improves the creep resistance. Therefore, the performance of the bowstring depends on how well the two materials perform together.

In some embodiments as described herein, 30 wt-% or less of the bowstring is LCP and 70 wt-% or more of the bowstring is UHMW-PO. Suitably about 10 wt-% to 30 wt-% of the bowstring is LCP and 70 wt-% to about 90 wt-% of the bowstring UHMW-PO. Even more suitably, about 20 wt-% to 30 wt-% of the bowstring is LCP and 70 wt-% to about 80 wt-% of the bowstring is UHMW-PO.

In the above described embodiments, there are enough LCP fibers, as determined by the weight percent of the LCP present in the bowstring, to inhibit the creep characteristics of the UHMW-PO without measurably decreasing the performance of the UHMW-PO.

In one specific embodiment, 23.5 wt-% of the bowstring is VECTRAN® HS LCP and 76.5 wt-% of the bowstring is SPECTRA® 1000 UHMW-PE which produces optimal properties.

One other factor that must be considered when determining the amount of LCP required and the amount of UHMW-PO required for optimum performance is the denier of each fiber. The blending of at least two fibers is particularly advantageous for those fibers that exhibit notch sensitivity because of the additional cushioning provided for those fibers. The better blending of the fibers, the better the cushioning affect. An example of a method for achieving optimal blending is air commingling of the fibers.

When selecting the specific blend of fibers for each strand ultimately used in the bowstring of the present invention, the denier (g/9000 m) or weight of each fiber may also be taken into account. The finer the denier that is used, the greater the cushioning effect on the LCP, and the greater the longevity of the strand material when exposed to cyclic bending. However, the finer the denier, the greater the cost so the selection is also based on the economics of buying a finer denier. For LCP, the denier is suitably 400 or less based on the foregoing reasons. This is not to say that a higher denier LCP could not be used. For the UHMW-PO, the denier is suitably 600 or more, and even more suitably about 800 to about 1800.

An example of a blend that is useful herein and that provides the desired performance characteristics is a 1425 denier blend that includes 1025 denier SPECTRA® 1000 fiber and 400 denier VECTRAN® HS fiber which yields a blend wherein 28 wt-% of bowstring is VECTRAN® LCP and 72 wt-% of the bowstring is SPECTRA® UHMW-PE.

Another example of a blend useful herein is a 1600 denier blend which includes 400 and 800 denier DYNEEMA® UHMW-PE and 400 denier VECTRAN® LCP which yields a blend wherein 25 wt-% of the bowstring is VECTRAN® LCP and 75 wt-% of the bowstring is SPECTRA® UHMW-PE.

Another specific example of a blend of fibers useful in making the strands and bowstrings of the present invention is a 1700 denier blend that includes 1300 denier SPECTRA® 1000 fiber and 400 denier VECTRAN® fiber which yields a blend which ultimately provides a bowstring composition which is 24 wt-% VECTRAN® LCP and 76 wt-% SPECTRA® UHMW-PE.

Each of these blends is found to have a sufficient amount of LCP to effectively reduce the amount of creep exhibited in a bowstring when combined with UHMW-PE. Further, this amount of LCP has been found to have a minimal adverse affect the performance characteristics of the UHMW-PE material.

Figure 14:
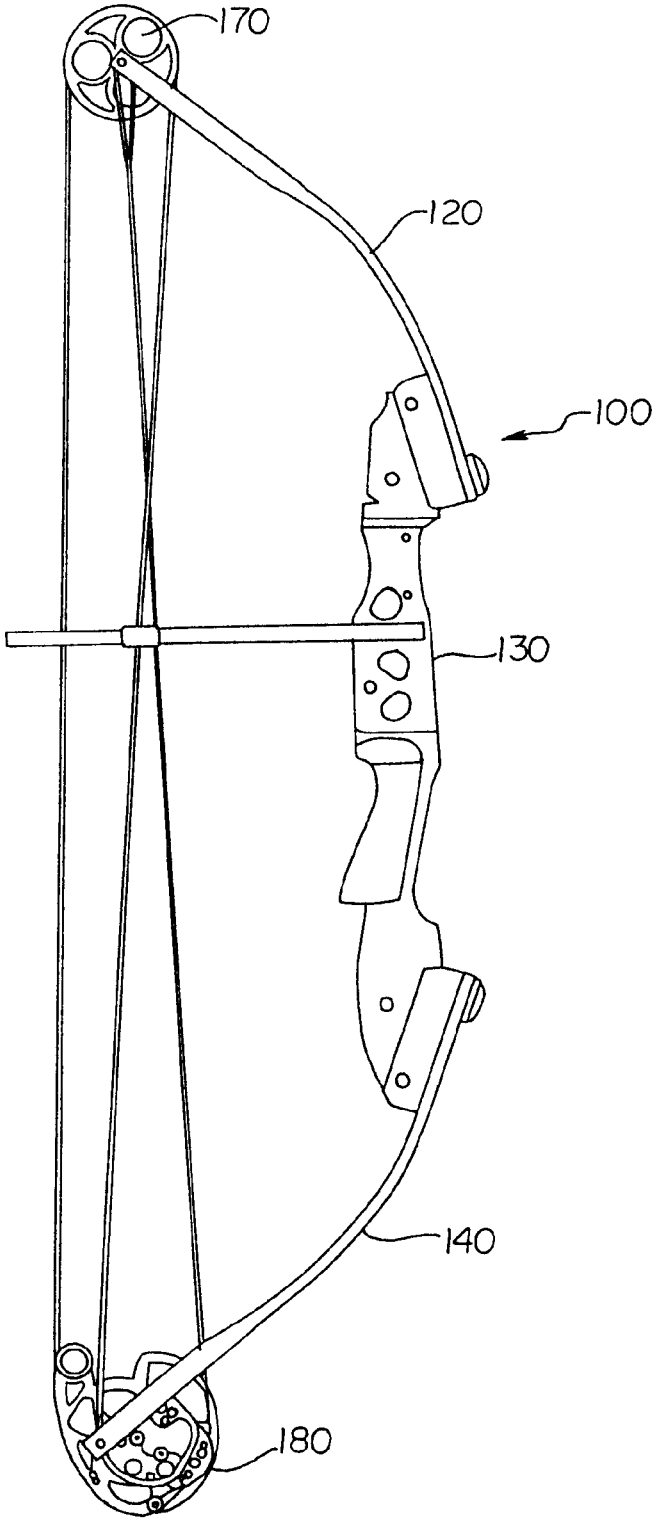
FIG. 14 illustrates a compound bow employing the bowstrings of the present invention.

The present invention may be utilized in combination with any archery bow. However, for purposes of illustration only, FIG. 14 shows one specific embodiment of a compound archery bow which is illustrated generally at 100. A first and second limb 120, 140 extending outwardly from handle portion 130. A first rotation assembly 170 and a second rotation assembly 180 are rotatably mounted on first and second limbs 120, 140. The rotation assemblies may be in the form of pulleys or cams. In this embodiment, rotation assembly 170 is in the form of a pulley and rotation assembly 180 is in the form of a cam.

Figure 15:
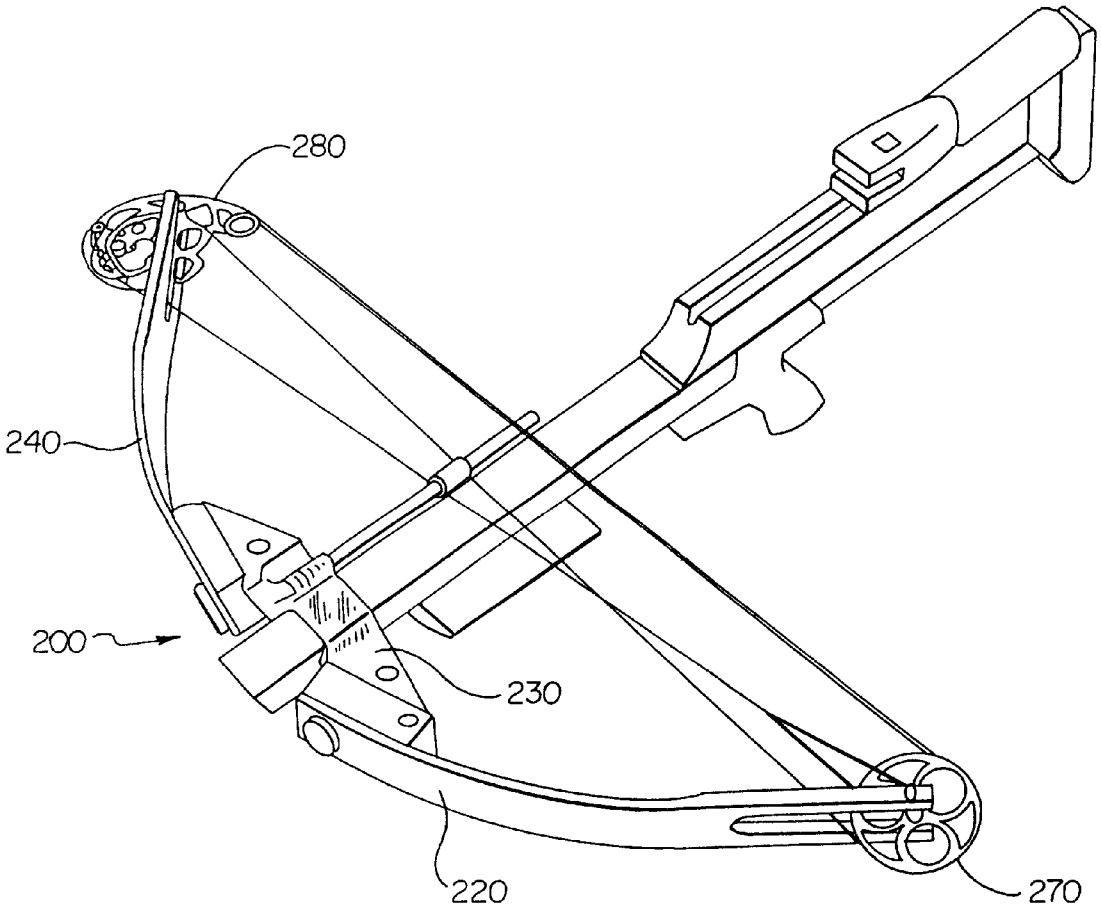
FIG. 15 illustrates a compound crossbow employing the bowstrings of the present invention.

FIG. 15 illustrates a cross bow generally at 200 illustrating, for purposes of this invention, the same features as shown in FIG. 14. Cross bow 200 has a limb mounting portion 230 from which first and second limbs 220, 240 extend outwardly. Rotation assemblies 270, 280 are rotatably mounted on first and second limbs 220, 240.

The type of archery bow described above is found in U.S. Pat. No. 6,237,582 incorporated by reference herein in its entirety. Modem day archers typically use compound bows, recurve bows, long bows, or variations such as of compound bows with recurve limbs. The bowstring of the present invention, however, is not limited to any particular type of archery bow.

The above descriptions and embodiments are intended for illustrative and exemplary purposes only, and are not intended to limit the scope of the present invention.

What is claimed is:

1. A bowstring comprising about 10 wt-% to 30 wt-% liquid crystal polymer and 70 wt-% to about 90 wt-% ultra high molecular weight polyolefin.

2. The bowstring of claim 1 wherein said bowstring is in a non-braided configuration.

3. The bowstring of claim 1 wherein said ultra high molecular weight polyolefin is polyethylene.

4. A bowstring comprising a plurality of strands each strand comprising at least a first fiber and a second fiber, said bowstring comprising about 10 wt-% to 30 wt-% liquid crystal polymer and 70 wt-% to about 90 wt-% ultra high molecular weight polyolefin.

5. The bowstring of claim 4 wherein at least one of said first fiber and said second fiber is liquid crystal polymer and said one of said first fiber and said second fiber is ultra high molecular weight polyolefin.

6. The bowstring of claim 4 wherein said first fiber is liquid crystal polymer and has a denier of 400 or less.

7. The bowstring of claim 4 wherein said second fiber is ultra high molecular weight polyolefin and has a denier of about 800 to about 1800.

8. The bowstring of claim 4 wherein said strands are in a non-braided configuration.

9. The bowstring of claim 4 wherein each of said strands comprises commingled or twisted fibers.

10. The bowstring of claim 4 wherein about 20 wt-% to 30 wt-% of the bowstring is liquid crystal polymer and 70 wt-% to about 80 wt-% of the bowstring is ultra high molecular weight polyolefin.

11. The bowstring of claim 4 wherein about 23 wt-% to 30 wt-% of the bowstring is liquid crystal polymer and 70 wt-% to about 77 wt-% of the bowstring is ultra high molecular weight polyolefin.

12. The bowstring of claim 4 wherein said polyolefin is polyethylene.

13. The bowstring of claim 4 comprised of a substantially equal number of strands twisted in the clockwise and strands twisted in the counterclockwise direction.

14. The bowstring of claim 4 comprising about 8 to about 22 strands.

15. The bowstring of claim 4 wherein each strand is twisted and has substantially the same number of twists per unit length.

16. An archery bow having a bowstring made up of a plurality of strands each strand comprising a blend of at least two fibers, said bowstring comprising about 10 wt-% to 30 wt-% liquid crystal polymer and 70 wt-% to about 90 wt-% ultra high molecular weight polyolefin.

17. The bow of claim 16 wherein said archery bow is a compound archery bow.

18. The bow of claim 16 wherein said bowstring is comprised of about 8 to about 22 strands.

19. The bow of claim 16 wherein said bowstring is comprised of a substantially equal number of strands twisted in the clockwise direction and strands twisted in the counterclockwise direction.

20. An archery bow comprising:

a handle portion;

upper and lower limbs having outer ends and attached to the handle portion and extending outwardly therefrom; and a bowstring connected to and extending between said limbs said bowstring comprising about 10 wt-% to 30 wt-% liquid crystal polymer and 70 wt-% to about 90 wt-% of ultra high molecular weight polyolefin.

21. The archery bow of claim 20 further comprising a pair of rotation members rotatably mounted on the outer ends of each limb.

22. The archery bow of claim 20 wherein said bowstring is comprised of a plurality of strands, each strand comprising at least two yarn titers of two different fibers.

23. The archery bow of claim 20 wherein each strand comprises a first fiber and a second fiber.

24. The archery bow of claim 23 wherein said at least one of said first fiber and said second fiber is liquid crystal polymer and at least one of said first fiber and said second fiber is ultra high molecular weight polyolefin.

25. The archery bow of claim 20 said bowstring comprising about 20 wt-% to 30 wt-% liquid crystal polymer and 70 wt-% to about 80 wt-% ultra high molecular weight polyolefin fibers.

26. The archery bow of claim 20 said bowstring comprising about 23 wt-% to 30 wt-% liquid crystal polymer and 70 wt-% to about 77 wt-% ultra high molecular weight polyolefin fibers.

27. A bowstring made up of a plurality of strands each strand comprising at least two fibers wherein said bowstring comprises about 10 wt-% to about 30 wt-% of a first material and 70 wt-% to about 90 wt-% of a second material, said first material and said second material having a substantially similar modulus of elasticity, said modulus of elasticity greater than about 8,000,000 psi, and at least one of said first material or said second material has a minimum ultimate tensile strength of about 350,000 psi.

28. The bowstring of claim 27 wherein said first material and said second material are polymeric materials.

29. A bowstring comprising a plurality of strands, each strand comprising at least one first fiber and at least one second fiber, said at least one first fiber or said at least one second fiber comprising liquid crystal polymer and said at least one first fiber or said at least one second fiber comprising ultra high molecular weight polyolefin.

* * * * *

UNITED STATES PATENT AND TRADEMARK OFFICE

CERTIFICATE OF CORRECTION

PATENT NO. : 6,651,643 B2
DATED : November 25, 2003
INVENTOR(S) : G. Simonds

It is certified that error appears in the above-identified patent and that said Letters Patent is hereby corrected as shown below:

Column 3,
Lines 21 and 23, delete "yams" and insert -- yarns --

Signed and Sealed this

Second Day of March, 2004

JON W. DUDAS
*Acting Director of the United States Patent and Trademark Office*